US008376415B2

(12) United States Patent
Uyeda

(10) Patent No.: US 8,376,415 B2
(45) Date of Patent: Feb. 19, 2013

(54) MULTIPLE DOOR LOCKING CONTROL

(75) Inventor: Alan K. Uyeda, Irvine, CA (US)

(73) Assignee: Adams Rite Manufacturing Co., Pomona, CA (US)

( * ) Notice: Subject to any disclaimer, the term of this patent is extended or adjusted under 35 U.S.C. 154(b) by 1170 days.

(21) Appl. No.: 12/157,964

(22) Filed: Jun. 16, 2008

(65) Prior Publication Data

US 2009/0308112 A1 Dec. 17, 2009

(51) Int. Cl.
*E05C 9/12* (2006.01)
*E05C 9/00* (2006.01)

(52) U.S. Cl. ..... 292/39; 292/51; 292/DIG. 21

(58) Field of Classification Search ..... 292/32, 292/33, 37, 39, 42, 44, 45, 49, 50, 51, 54, 292/92, DIG. 4, DIG. 21, DIG. 65, DIG. 68; 70/107–111, DIG. 65
See application file for complete search history.

(56) References Cited

U.S. PATENT DOCUMENTS

| | | | | | |
|---|---|---|---|---|---|
| 23,264 | A * | 3/1859 | Roberts | 292/36 |
| 902,412 | A * | 10/1908 | Jones | 292/36 |
| 932,330 | A * | 8/1909 | Rotchford | 70/118 |
| 966,208 | A * | 8/1910 | Hoes | 70/108 |
| 980,131 | A * | 12/1910 | Shean | 292/36 |
| 1,023,766 | A * | 4/1912 | Sinclair | 292/5 |
| 1,051,918 | A * | 2/1913 | Rowley | 292/7 |
| 1,075,914 | A * | 10/1913 | Hoes | 70/108 |
| 1,124,372 | A * | 1/1915 | Willich | 292/36 |
| 1,146,086 | A * | 7/1915 | MacKenzie | 292/39 |
| 1,247,052 | A * | 11/1917 | Wilson | 292/5 |
| 1,368,141 | A * | 2/1921 | Hagstrom | 292/34 |
| 1,536,829 | A * | 5/1925 | Dyer | 292/92 |
| 1,974,253 | A * | 9/1934 | Sandor | 70/118 |
| 3,570,285 | A * | 3/1971 | Hawkins | 70/107 |
| 6,120,071 | A * | 9/2000 | Picard et al. | 292/165 |
| 6,733,051 | B1 * | 5/2004 | Cowper | 292/196 |

FOREIGN PATENT DOCUMENTS

JP 54108798 A * 8/1979

* cited by examiner

*Primary Examiner* — Carlos Lugo
(74) *Attorney, Agent, or Firm* — Woods Oviatt Gilman LLP

(57) ABSTRACT

The method of controlling unlocking of one or both side by side doors, that include providing two rotary input devices; providing a first mechanism responsive to rotation of one of the devices, to unlock one of the doors; providing a second mechanism responsive to rotation of the other of the devices to unlock both of the doors, the second mechanism operatively coupled to the first mechanism, to activate the first mechanism after predetermined rotation of the other device.

12 Claims, 14 Drawing Sheets

MULTIPLE DOOR LOCKING CONTROL

BACKGROUND OF THE INVENTION

This invention relates generally to controlling the unlocking of doors, and more particularly to unlocking of double doors, as from opposite sides thereof.

There is need for compact, simple, durable, and efficient door unlocking operation, and method, particularly when side-by-side independently openable doors are employed, and unlocking is required at opposite sides of such doors. This is of particular need when simultaneous unlocking of both such doors is required, along with capability to unlock only one door from one side, and to unlock both doors from the opposite side.

SUMMARY OF THE INVENTION

It is a major object of the invention to provide door unlocking apparatus and methods of operation, to meet the above need. Basically the method of the invention includes:

a) providing two rotary input devices, b) providing first means responsive to rotation of one of the devices, to unlock one of the doors, c) providing second means responsive to rotation of the other of the devices to unlock both of the doors, d) said second means operatively coupled to such first means, to activate such first means after predetermined rotation of the other device.

As will be seen, the two input devices may be provided to have a common axis of rotation, for simplicity and compactness. The one device typically comprises a rotatable knob, and the other device comprises a rotatable handle lever, one being at one side of the doors, and the other at the opposite side of the doors.

Another object includes the provision of such apparatus configured to bodily move, endwise, vertical lock rod means to lock and unlock the doors in response to rotation of said other device, the lock rod means operatively coupled to one or both of the first and second means. Further, the first means may include latch mechanism located for release to control door unlocking, in response to rotation of either of such devices.

These and other objects and advantages of the invention, as well as the details of an illustrative embodiment, will be more fully understood from the following specification and drawings, in which:

DRAWING DESCRIPTION

Figure 20:
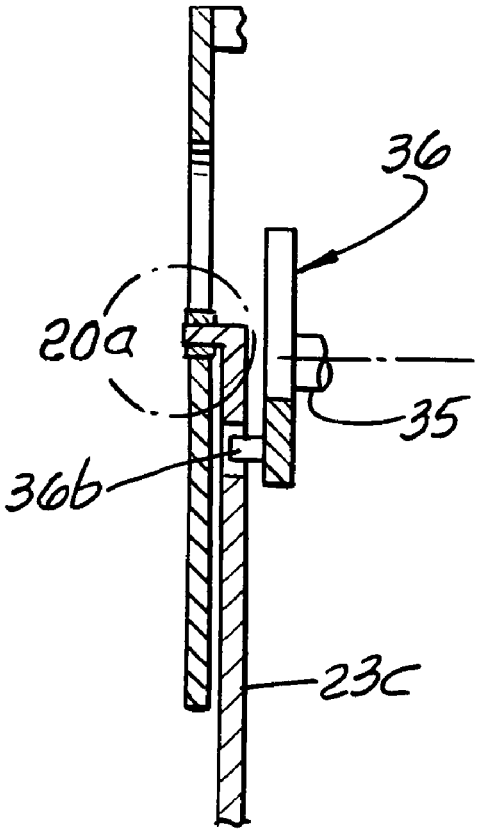
FIG. 20 is a vertical section showing cam actuation of a lock rod, with that rod in lowered, (extended) door locking position, the cam located on a multifunctional shaft.
Figure 21:
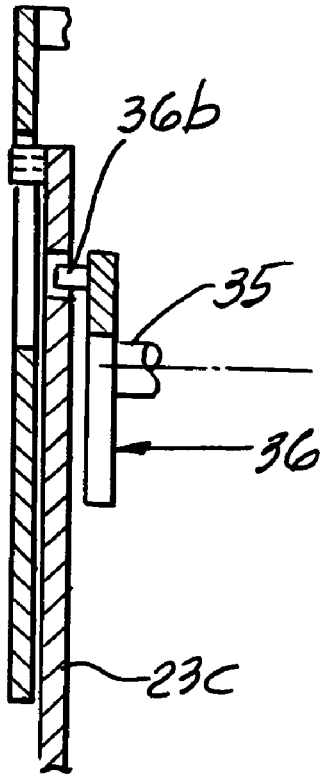
Figure 20A:
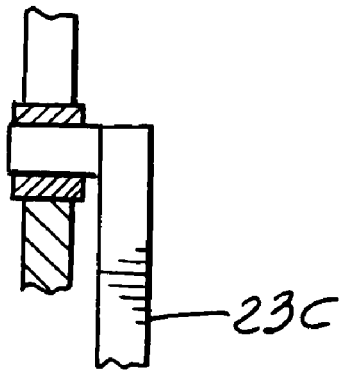
Figure 22A:
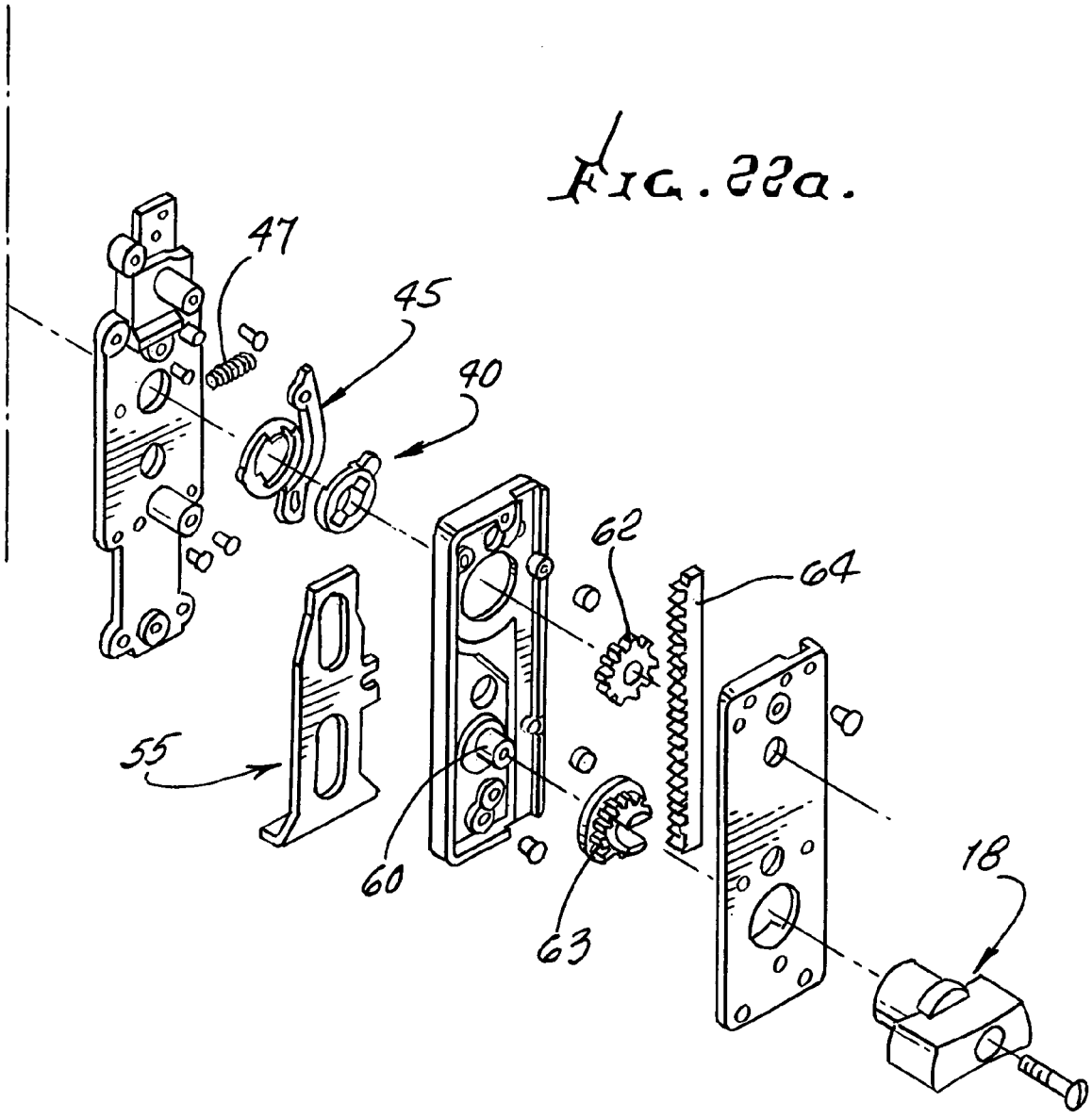

FIG. 20*a* is an enlarged vertical and fragmentary section, taken on line 20*a* of FIG. 20;

FIG. 21 is like FIG. 20, but showing the cam in lower lock rod elevated (retracted) position;

FIG. 22*a* is an exploded view of certain lock apparatus elements; and

Figure 22B:
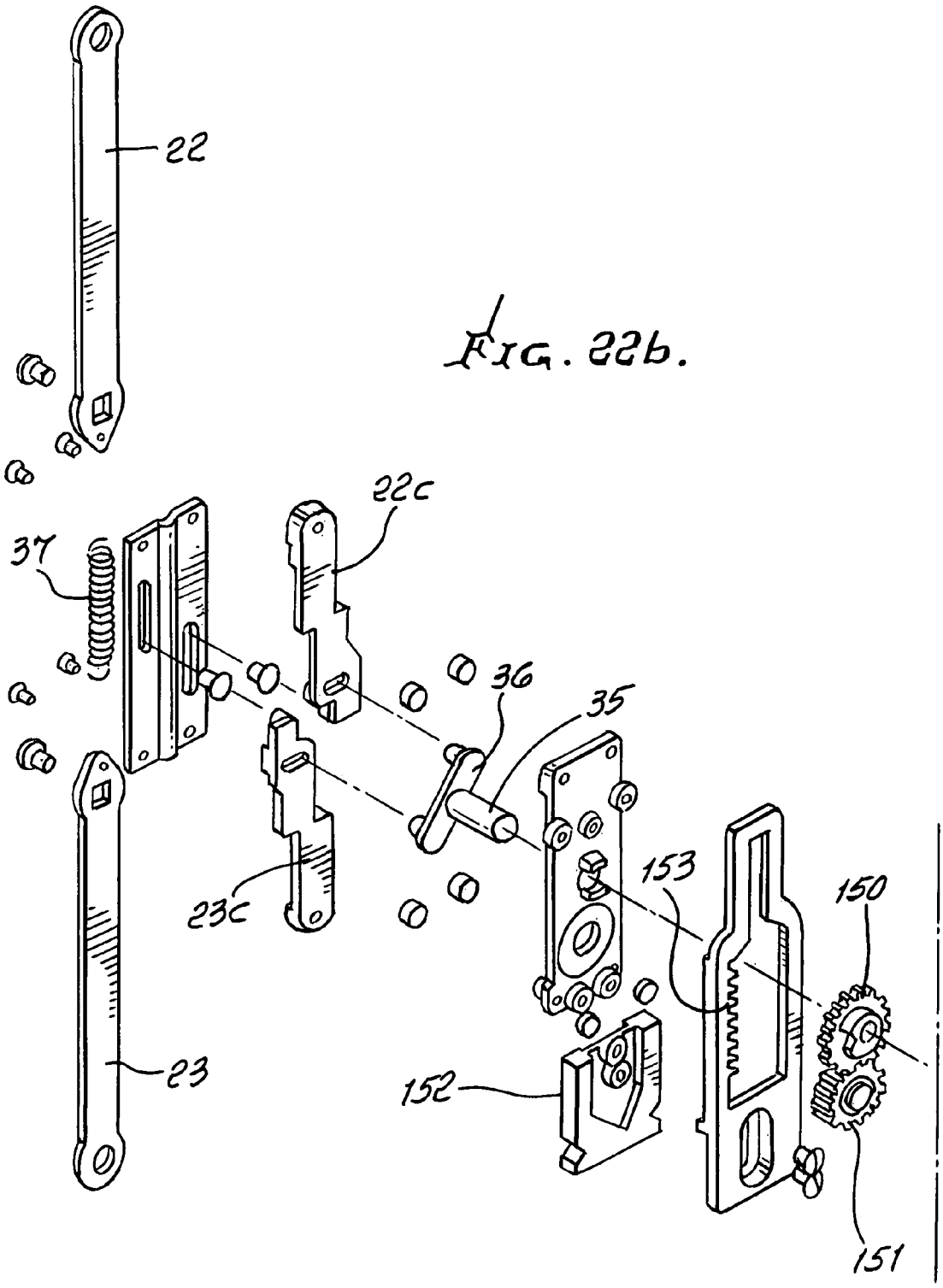

FIG. 22*b* is an exploded view of other lock apparatus elements.

DETAILED DESCRIPTION

Figure 1:
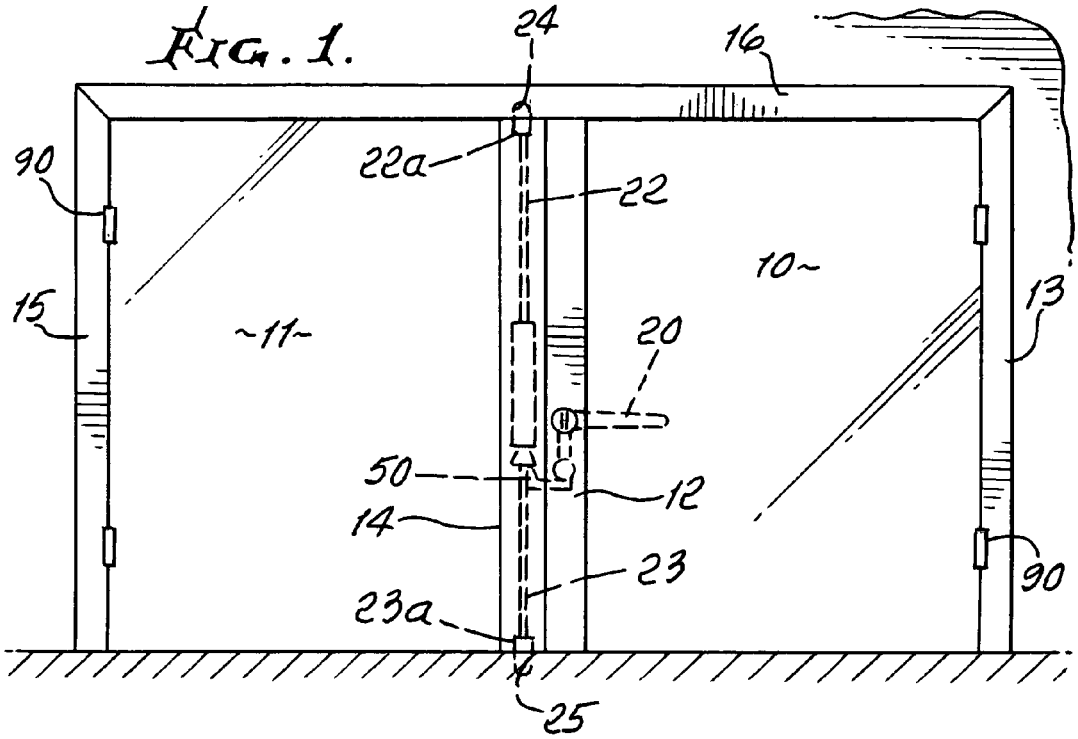
FIG. 1 is an elevation showing twin or double doors, at one side thereof and in locked condition, and apparatus to control locking and unlocking.
Figure 2:
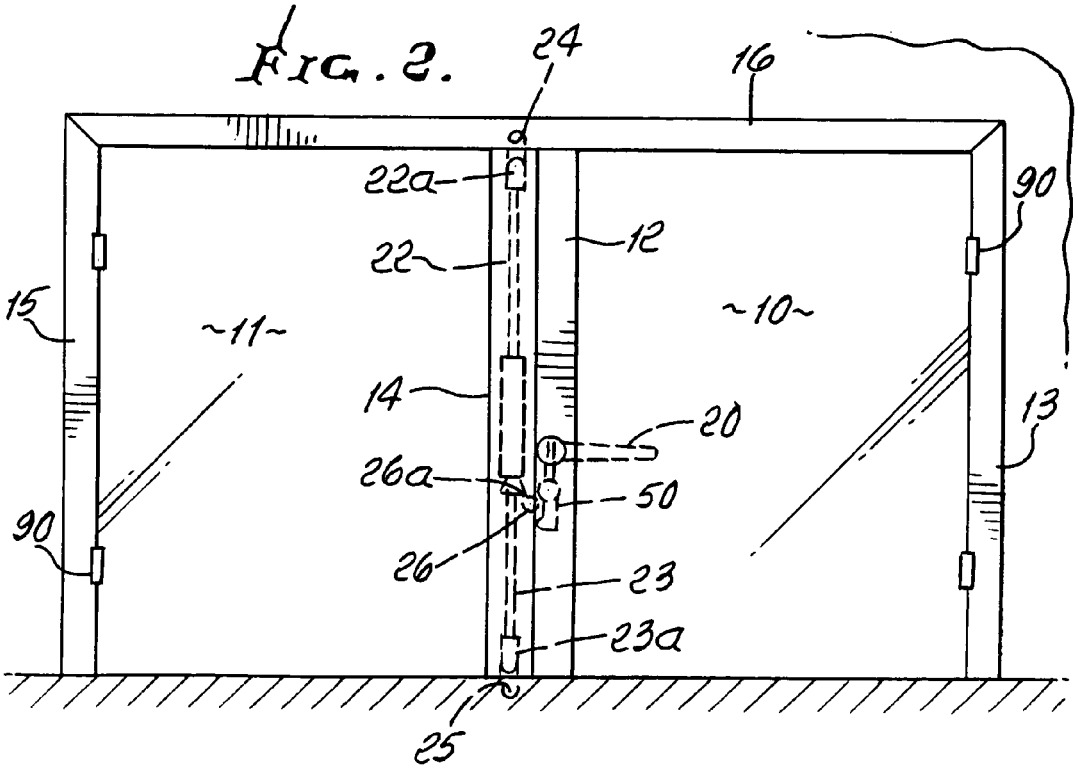
FIG. 2 is like FIG. 1, but showing the doors in unlocked condition.
Figure 3:
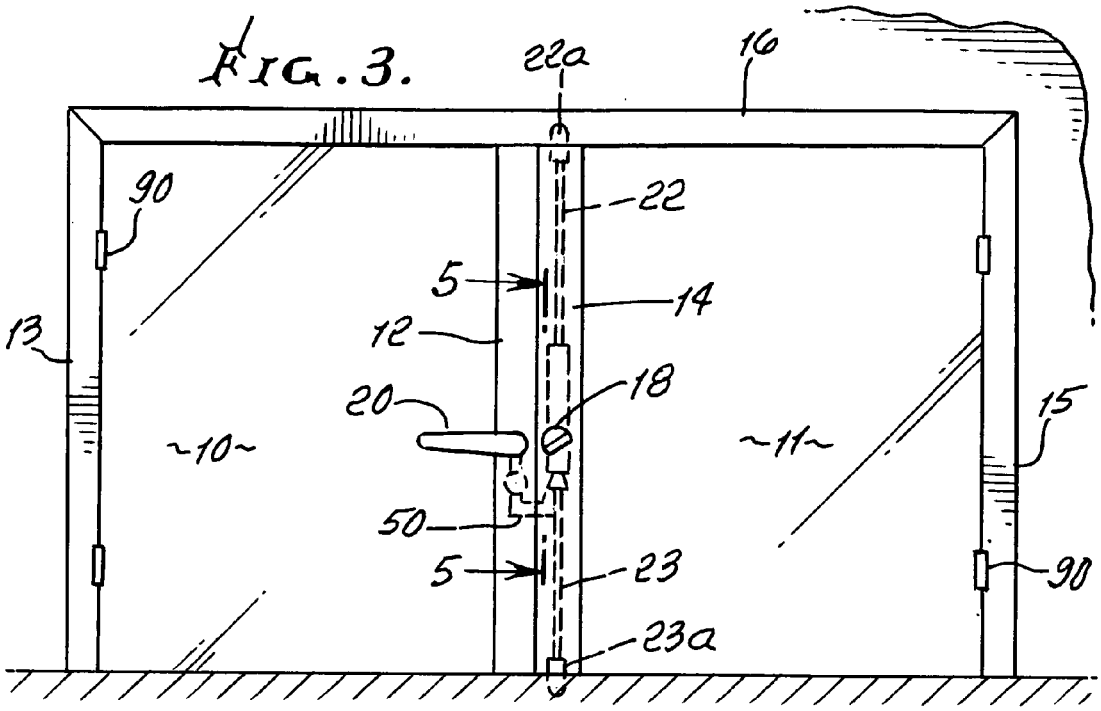
FIG. 3 is an elevation showing the doors of FIG. 1, viewed at the opposite side thereof, the doors being locked; apparatus for controlling locking and unlocking of only one door also being shown.
Figure 4:
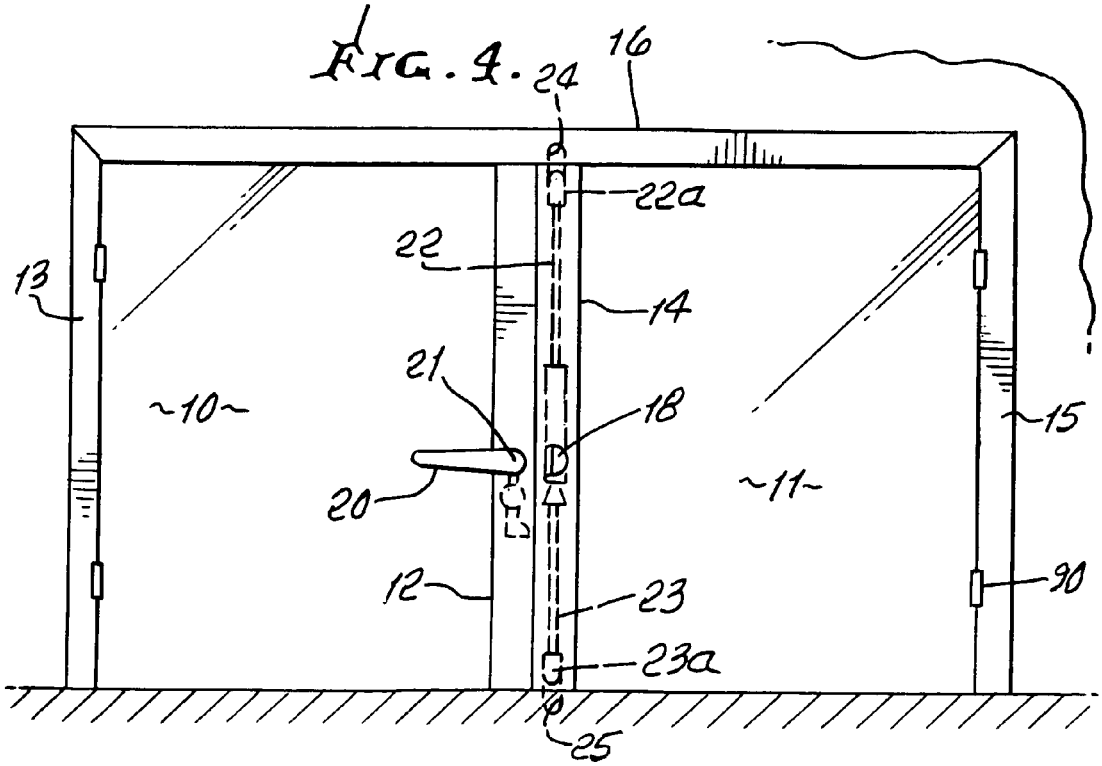
FIG. 4 is an elevation like FIG. 3, but showing the doors in unlocked condition.

In FIG. 1, twin, side-by-side doors are indicated at 10 and 11, with vertical frame members 12-15, and top cross frame member 16. Door 10 is typically hinge connected to frame member 13, to swing between open and closed position; and door 11 is typically hinge connected to frame member 15, to swing between open and closed positions. See hinges 90. Door 10 includes frame member 12 so that frame member 12 moves with respect to frame members 13, 16 when door 10 is moved between opened and closed positions. Door 10 may be considered as an "active" door, i.e. normally used for in and out access. Door 11 includes frame member 14 so that frame member 14 moves with respect to frame members 15, 16 when door 10 is moved between opened and closed positions. Door 11 may be considered as an inactive door, to be opened in an emergency. Also, the FIGS. 1 and 2 views are looking at the doors from the outside. FIGS. 3 and 4 show the doors as they appear at the inside of a building, a rotary handle knob 18 being used to open active door 10. In an emergency, handle lever 20, pivoted at 21 to frame member 12 may be swung to quickly unlock both doors, enabling rapid exit from the building.

The knob 18 may be considered as representative of a rotary input device operable to unlock one of the doors; and the lever 20 may be considered as representative of a device to unlock both of the doors. In this regard, first means is provided to be responsive to rotation of knob 18 to unlock active door 10; and second means is provided to be responsive to rotation of the lever 20 to unlock both doors, 10 and 11.

As will be seen, bodily endwise movable lock rod means is or are provided to lock and unlock the doors, in response to rotation of the knob 18; and also to unlock both of the doors in response to rotation of the handle or lever 20. Such lock rod means typically may include an upper rod 22 and a lower rod 23, endwise movable within door frame member 14 between locking position seen in FIGS. 1 and 3, and unlocking positions seen in FIGS. 2 and 4. Note the rod ends 22*a* and 23*a* which are carried into locking recesses 24 and 25 in FIGS. 1 and 3, and out of those recesses in FIGS. 2 and 4. As seen in FIGS. 1-4, the knob 18 and lever 20 may be at the same elevation. The handle lever also operates to cause a bolt 26 to frame member 12 to be retracted from a slot 26*a* in frame member 14, when the lever is moved downward to unblock door 10 from locked position. See FIG. 2.

Figure 5:
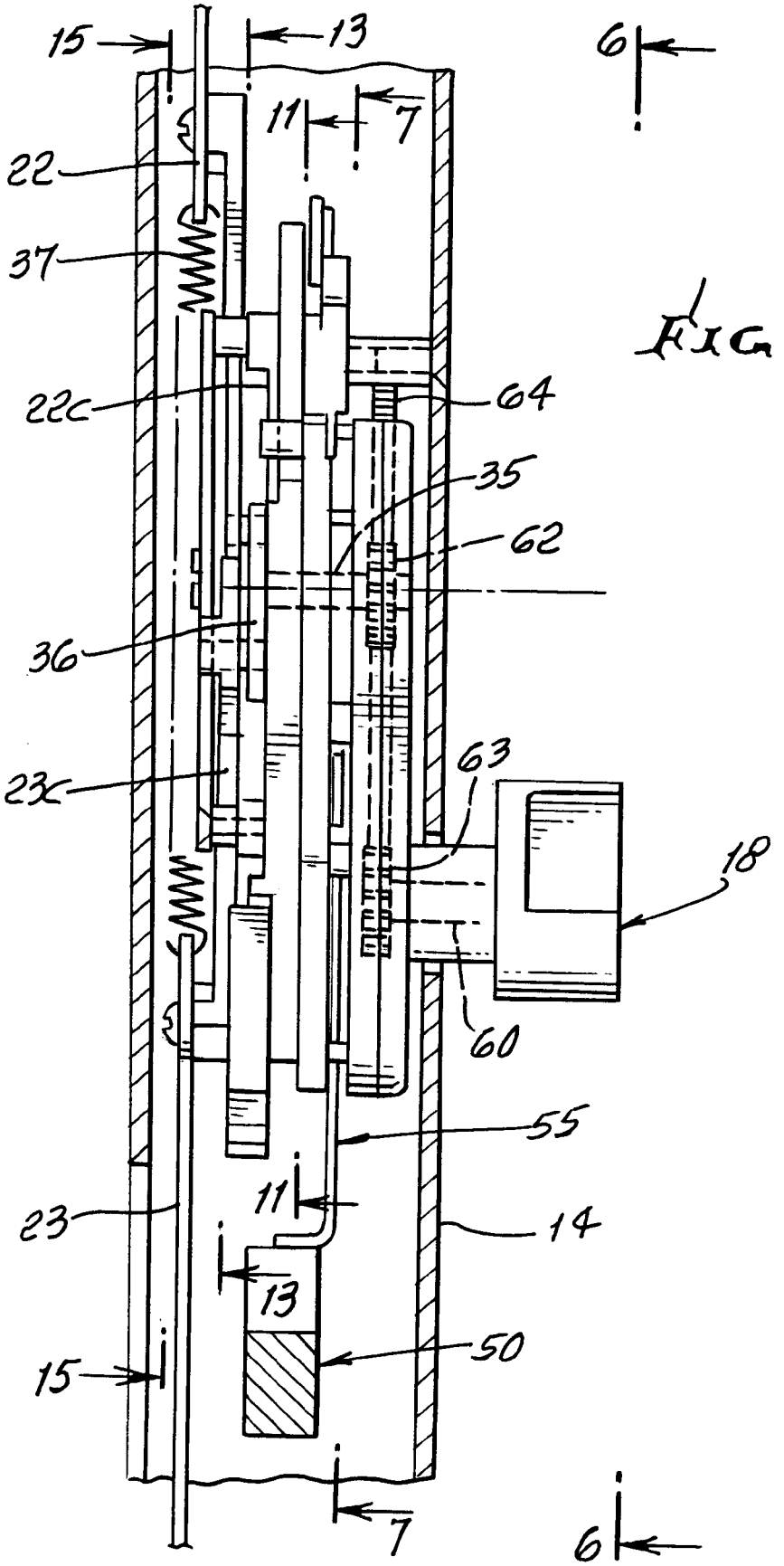
FIG. 5 is an enlarged elevation taken on lines 5-5 of FIG. 3.
Figure 6:
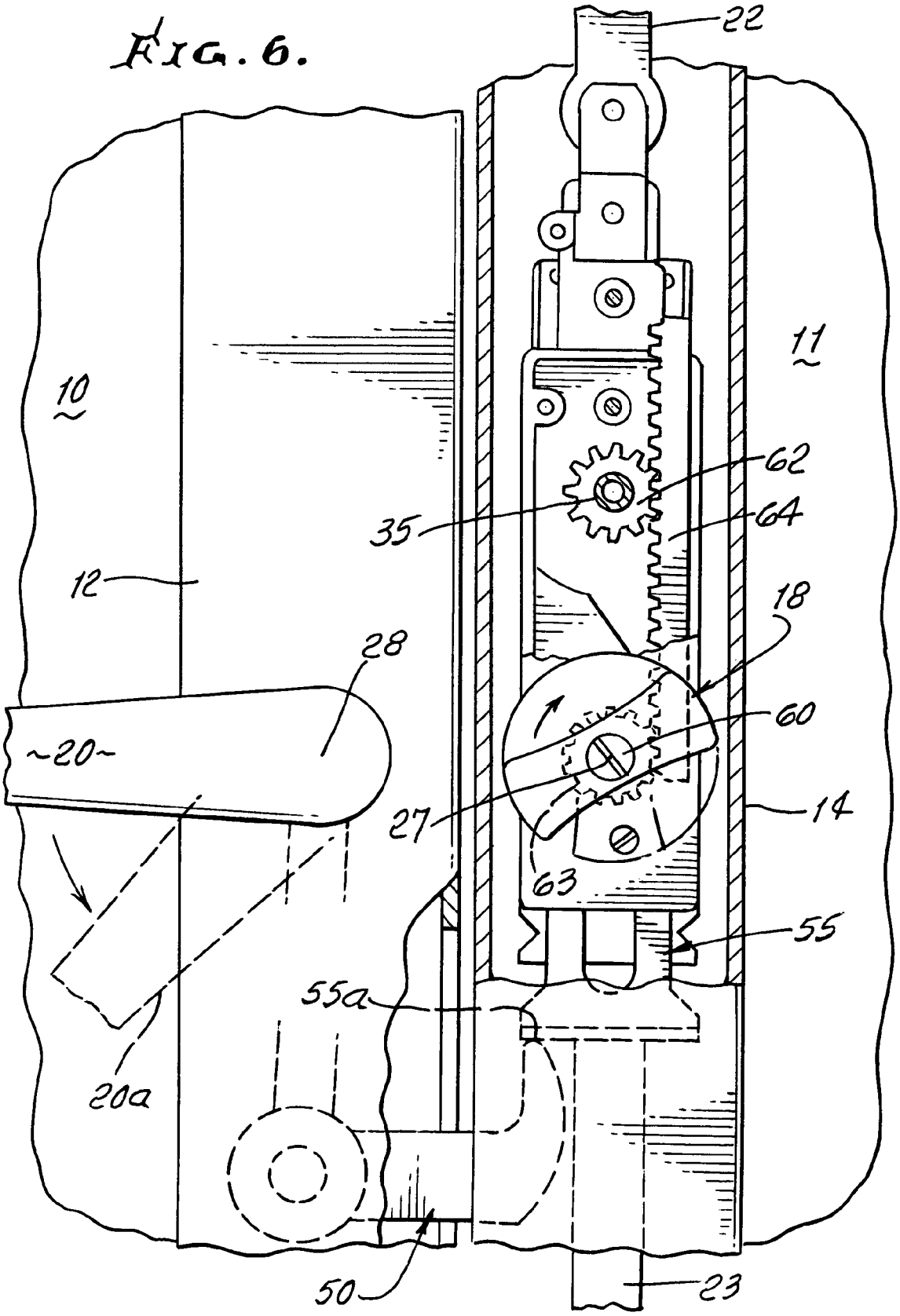
FIG. 6 is an elevation taken on lines 6-6 of FIG. 5.

Extending the description to FIGS. 5 and 6, the knob 18 and handle may also have offset axes of pivoting 27 and 28 at the same vertical level, as indicated.

Figure 13:
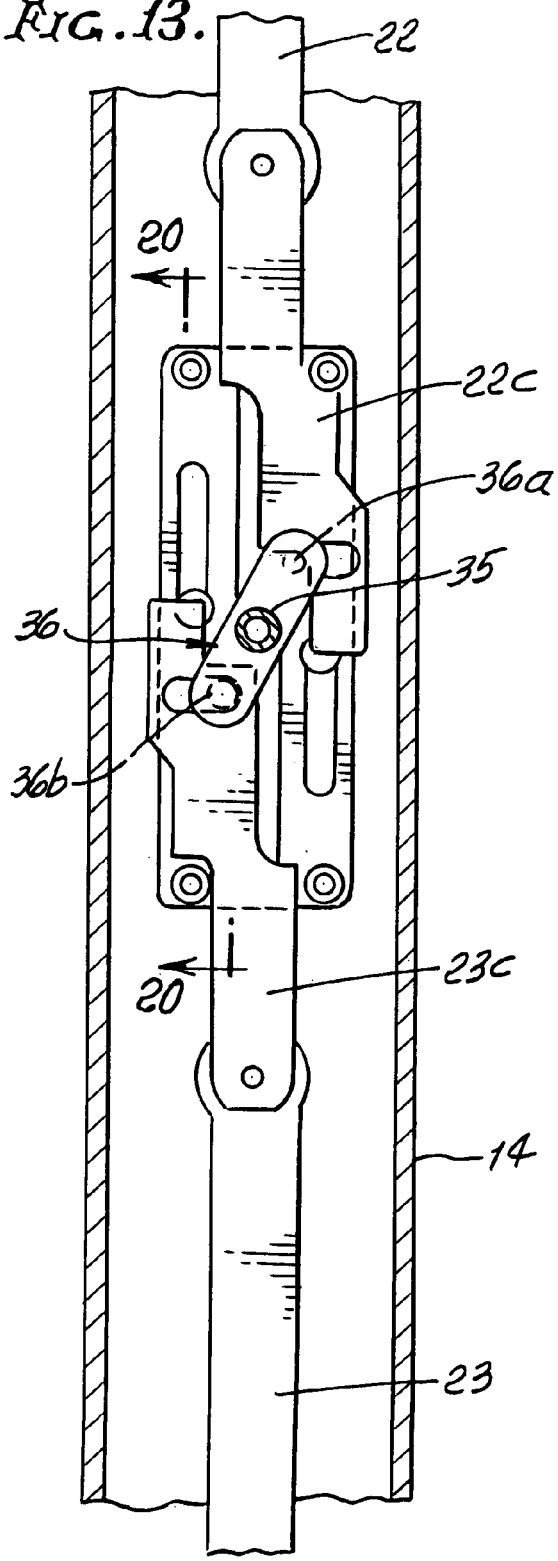
FIG. 13 is an elevation taken on lines 13-13 of FIG. 5, and showing mechanism in blocked position.
Figure 14:
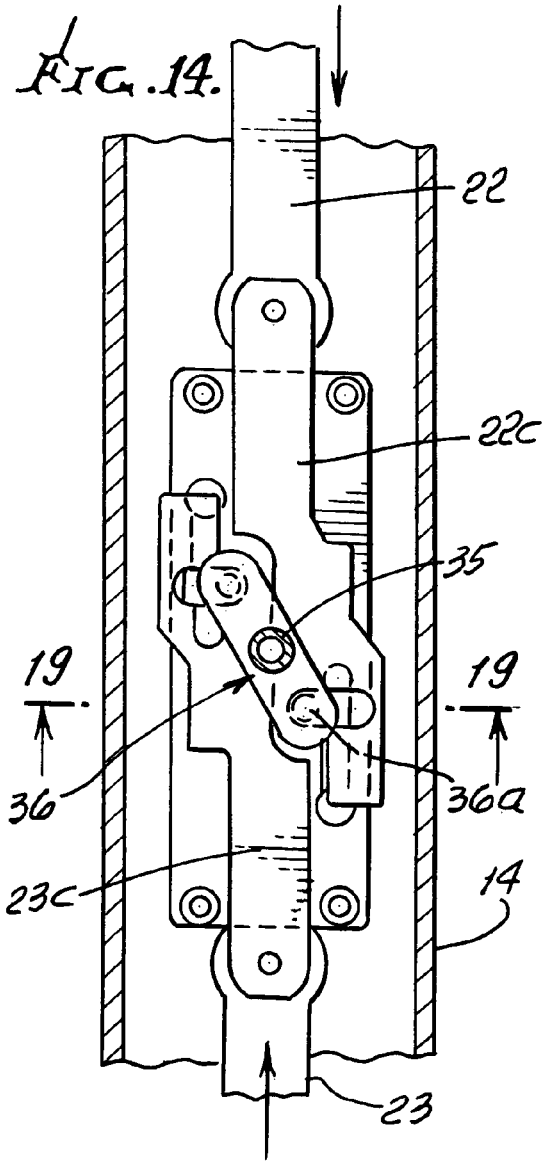
FIG. 14 is a view like FIG. 13, but showing the mechanism in unblocked position.
Figure 19:
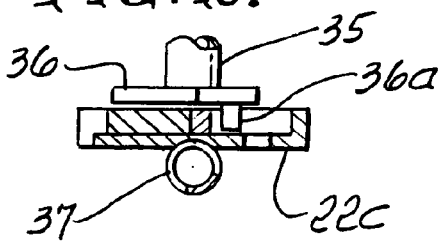
FIG. 19 is a horizontal section taken on lines 19-19 of FIG. 14.

FIGS. 13 and 14 show the latching mechanism to include a transverse shaft 35 carried by and within hollow upright frame member 14; and a linkage operatively connecting the shaft to the upper and lower lock rods 22 and 23 extending vertically and movable endwise to lock and unlock the doors, in response to rotation of the shaft 35. In FIG. 13, the shaft has been rotated counter-clockwise to cause rotary link 36 to extend slider 22*c* upwardly (moving rod 22 upwardly into door locking position) and to extend slider 23*c* downwardly (moving lower rod 23 downwardly into door locking position).

Figure 15:
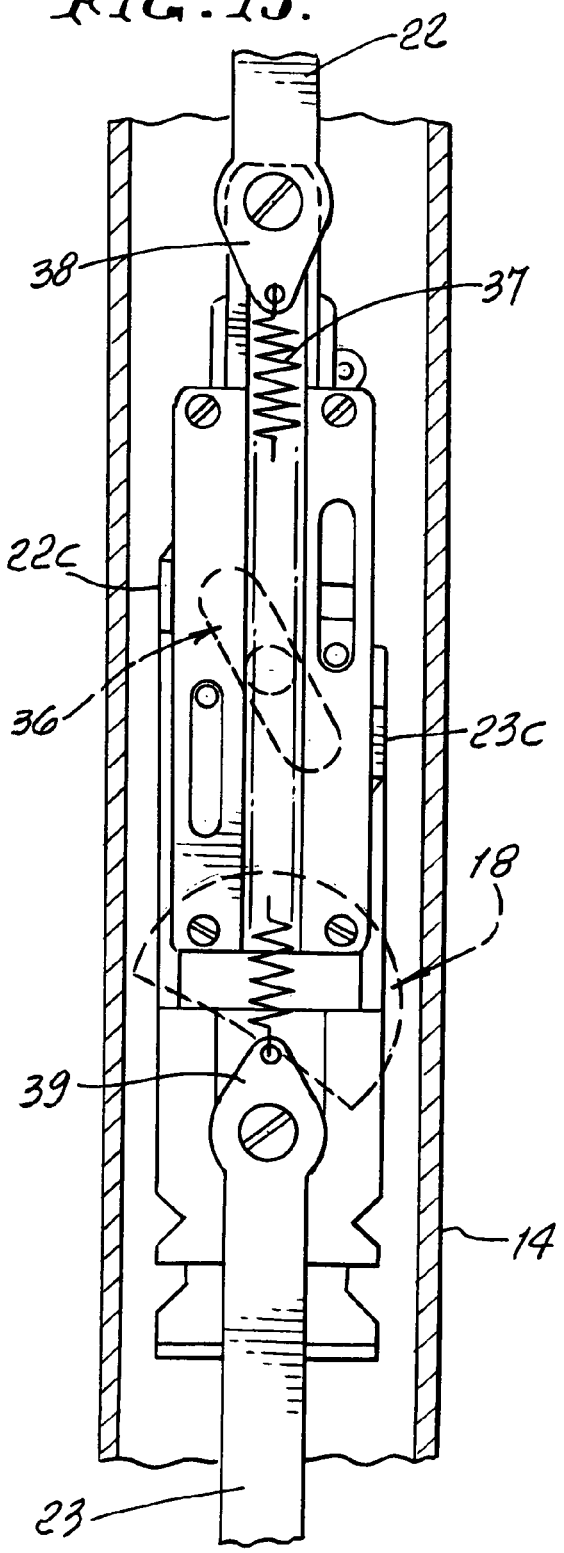
FIG. 15 is an elevation taken on lines 15-15 of FIG. 5, and showing mechanism in blocked position.
Figure 16:
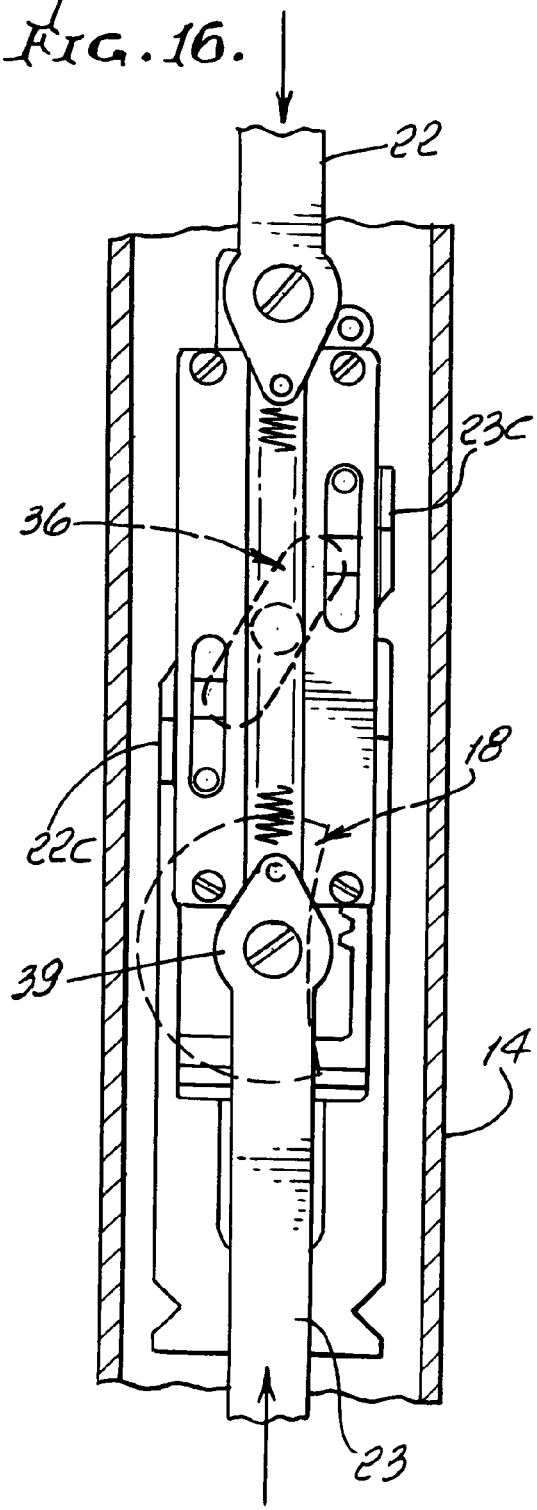
FIG. 16 is a view like FIG. 15, but showing mechanism in unblocked position.
Figure 17:
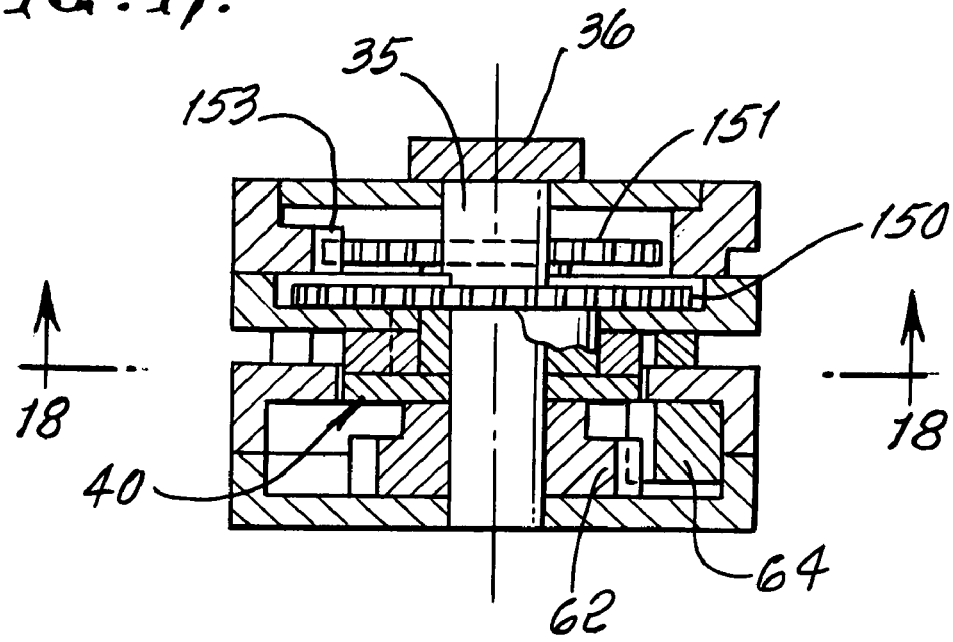
FIG. 17 is a horizontal section, taken on lines 17-17 of FIG. 8.
Figure 18:
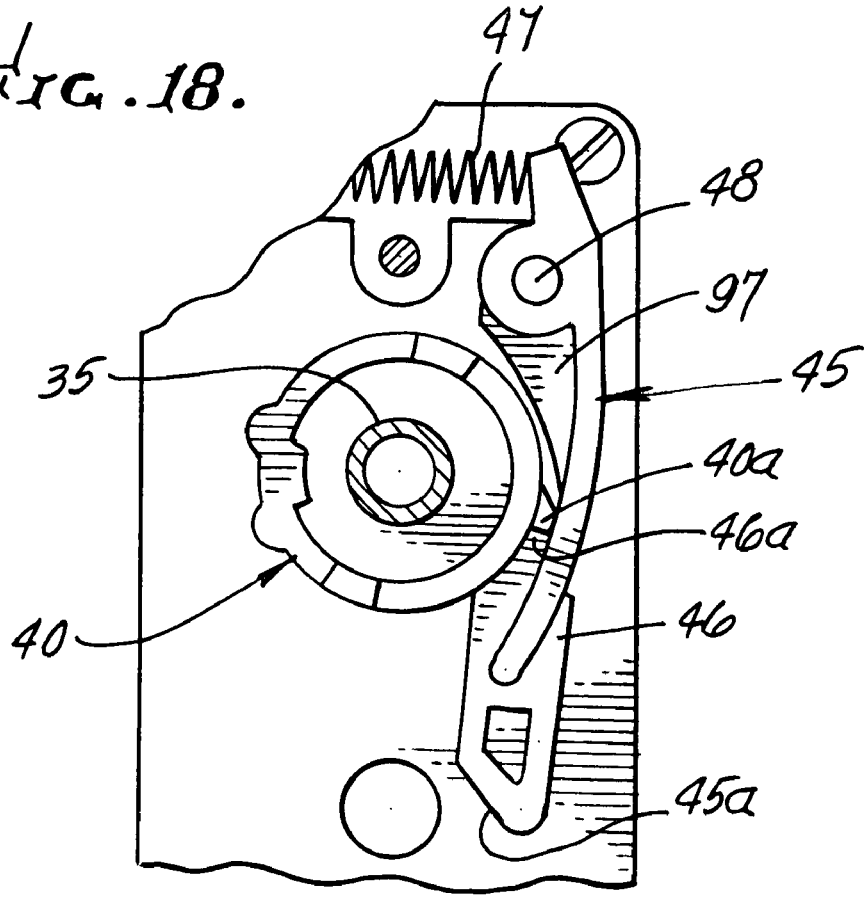
FIG. 18 is a fragmentary vertical section taken on lines 18-18 of FIG. 17.

Link 36 has pin and groove slidable connections at 36*a* to slider 22*c*, and at 36*b* to slider 23*c*. In FIG. 14, the link 36 has been rotated by shaft 35 to retract the sliders and lock rods, to door unblocking positions, allowing door 11 opening and closing, relative to the frame member 12. FIGS. 15 and 16 show spring means, such as a tension spring 37, connected at 38 and 39 to the lock rods, to positively urge them toward retracted position, in conjunction with shaft rotation, as by sudden unblocking rotary release of a blocking cam 40, on shaft 35. Therefore, when cam 40 is suddenly released to rotate, the locking rods are retracted, the spring 37 providing force acting through the mechanism to rotate that cam clockwise, in FIG. 8.

Referring again to FIG. 8, a latch or latch arm 45 carries a downward projection 46 swingable and biased clockwise into rotation blocking relation with the cam 40. See biasing spring 47 urging arm 45 clockwise about pivot 48 so that ledge 46*a* on projection 46 bears on the cam surface, and drops into the position shown, engaging cam step shoulder 40*a*, in FIG. 8. Ledge 46*a* is angled to be forcibly over-ridden by 40*a* in response to forcible turning at knob 18.

When latch arm 45 is pivoted counter-clockwise, either by knob 18 rotation (to cause shoulder 40*a* to ride over the ledge 46*a*) or by handle lever 20 rotation to pivotally deflect the latch arm 45 counter-clockwise, to release blocking engagement of 40*a* and 46*a*, the cam 40 suddenly releases and rotates, as referred to above allowing spring 37 to release the rods 22 and 23. See FIG. 9 in this regard. A guide lug 96 on 35 guides in a slot 97 in latch 45, to keep 40*a* and 46*a* aligned.

Figure 8:
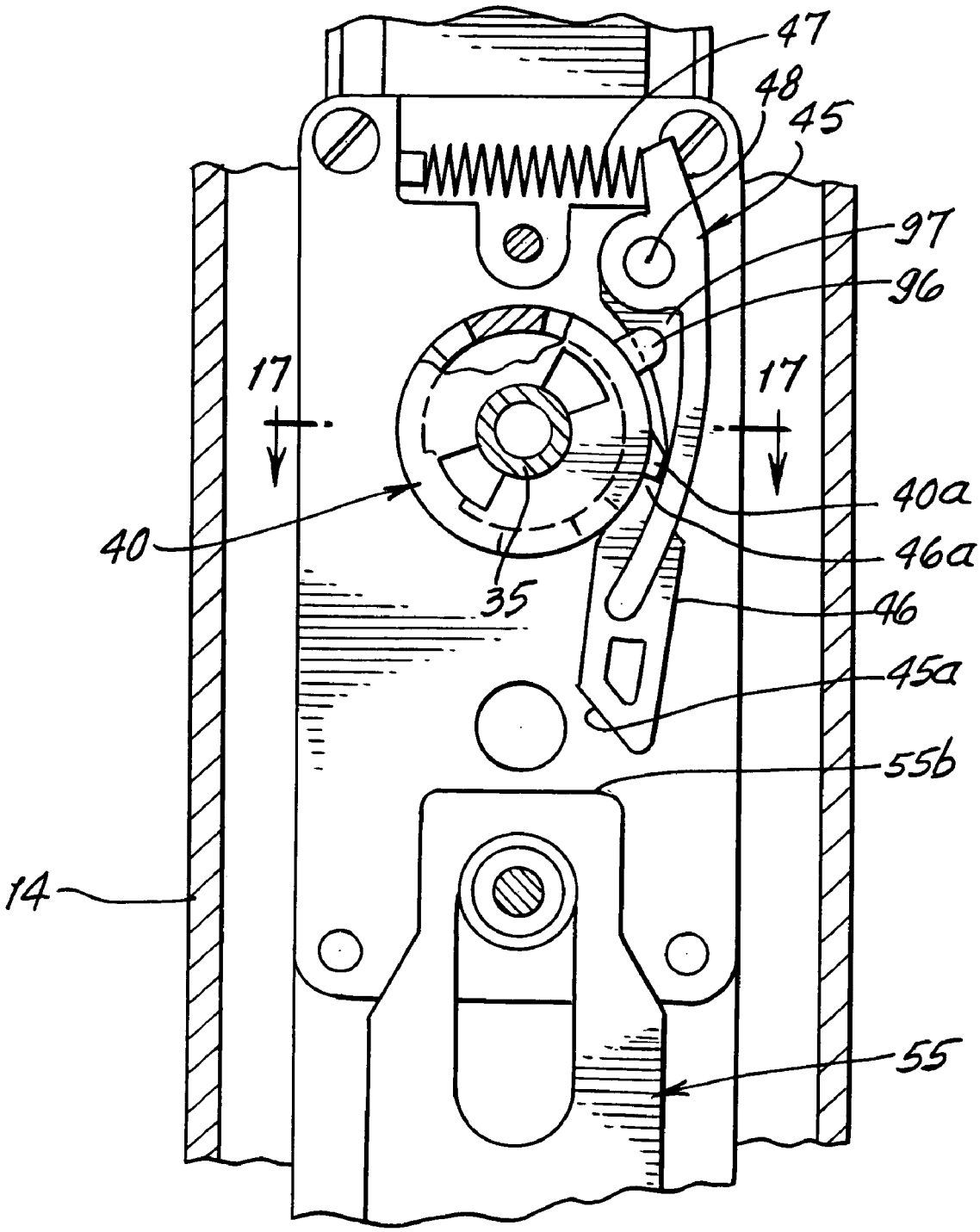
FIG. 8 is an enlarged view showing elements of FIG. 7, with a latch element in raised (up) position.
Figure 9:
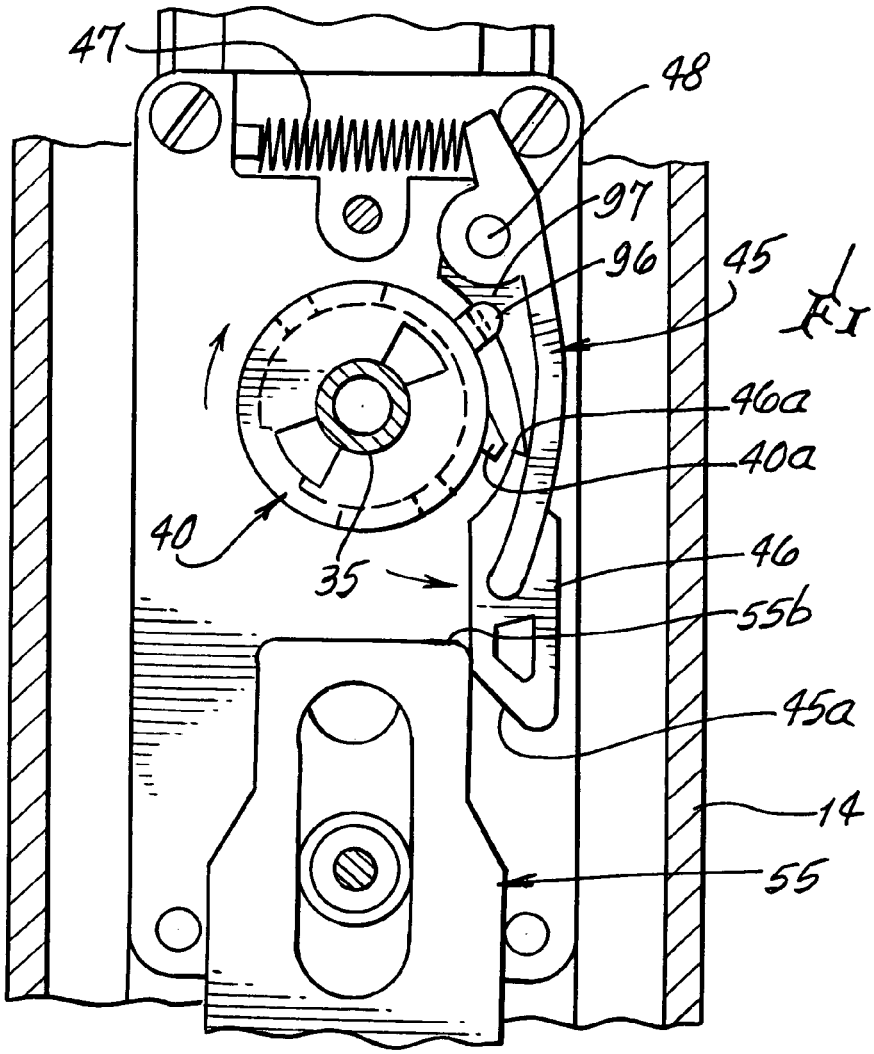
FIG. 9 is a view like FIG. 8, with the latch element shown in down position.
Figure 10:
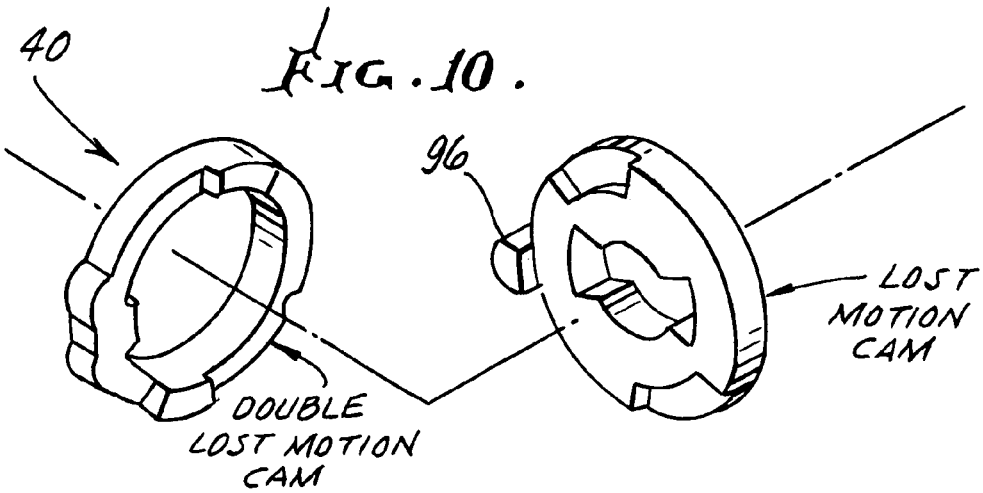
FIG. 10 is a perspective view showing rotatable cams, providing lost motion (see also FIGS. 9 and 22*a;*

Lever 20 rotation not only releases bolt connection at 26 and 26*a*, of door 11 to frame member 12, but also causes a projection 50 associated with that lever to rotate upwardly and actuate a slider 55, at location 55*a* pushing it upwardly, as from FIGS. 6 and 8 position, to FIG. 9 position. The upper edge 55*b* of the slider, in FIG. 9 has engaged the latch arm 45, at cam surface 45*a* to pivot it clockwise as referred to above to unblock cam 40. This also results in release and retraction of the locking arms 22 and 23 as described. Pivoting of the lever 20 also retracts projection or bolt 26 from captivation in frame 14, allowing door 10 to be opened, along with door 11. Cam 40 also has a lost motion rotation feature, to enhance positive door locking and unlocking.

When the lever 20 is manually released and returned to FIG. 4 position, the slider 55 drops down, by gravity action, allowing the latch 45 to return to FIG. 8 position, as the knob 18 is rotated to lock the doors.

Knob 18 is shown as mounted on a transverse shaft 60, below shaft 35, in FIG. 6. Shaft 60 is carried by frame member 14, which enables the knob 18 to be positioned at the same vertical level as the lever 20. Shaft 60 is operatively connected with shaft 35, as via gears 62 and 63 on shafts 35 and 60, and endwise movable rack 64.

Figure 7:
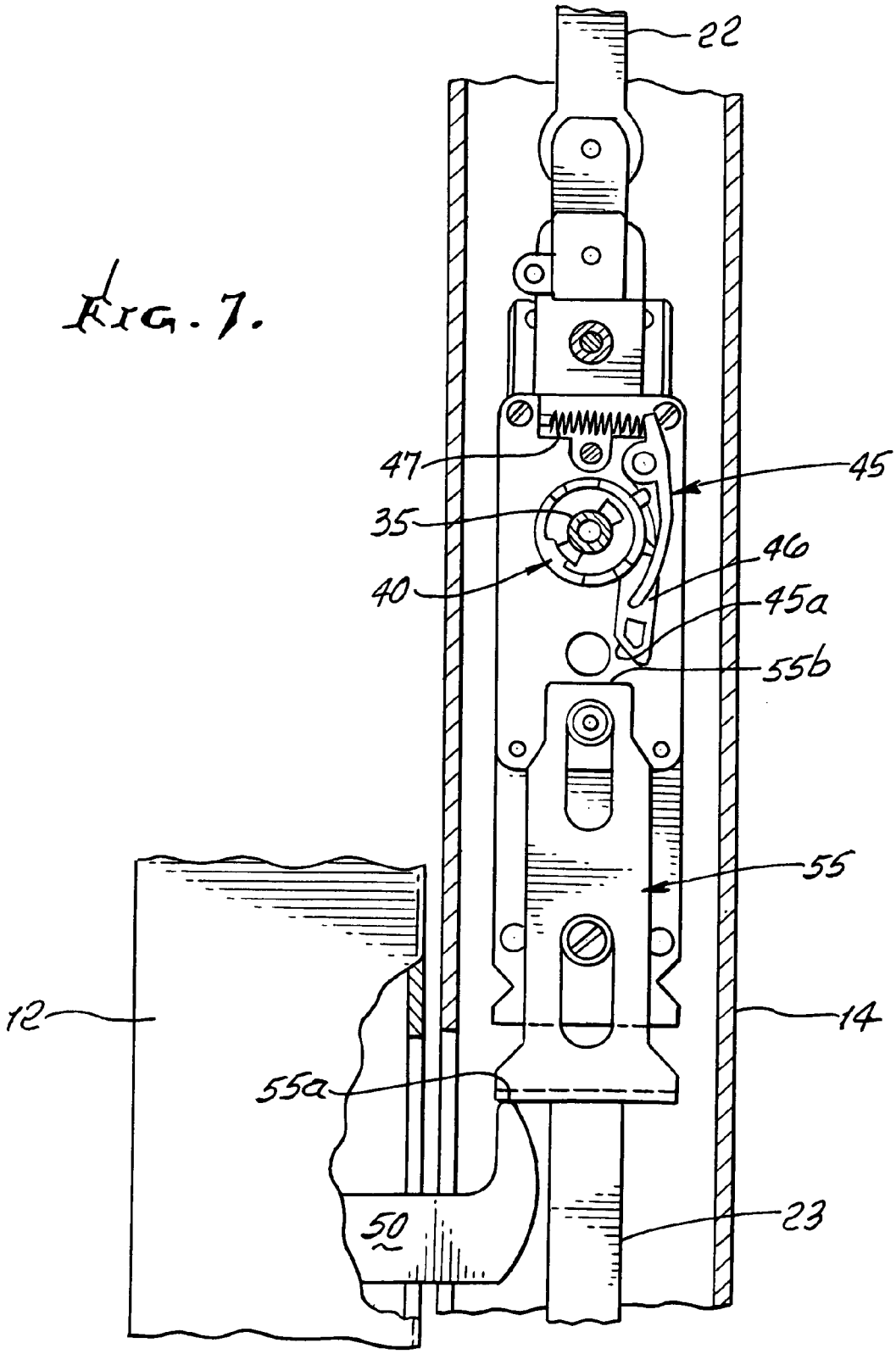
FIG. 7 is an elevation taken on lines 7-7 of FIG. 5.
Figure 11:
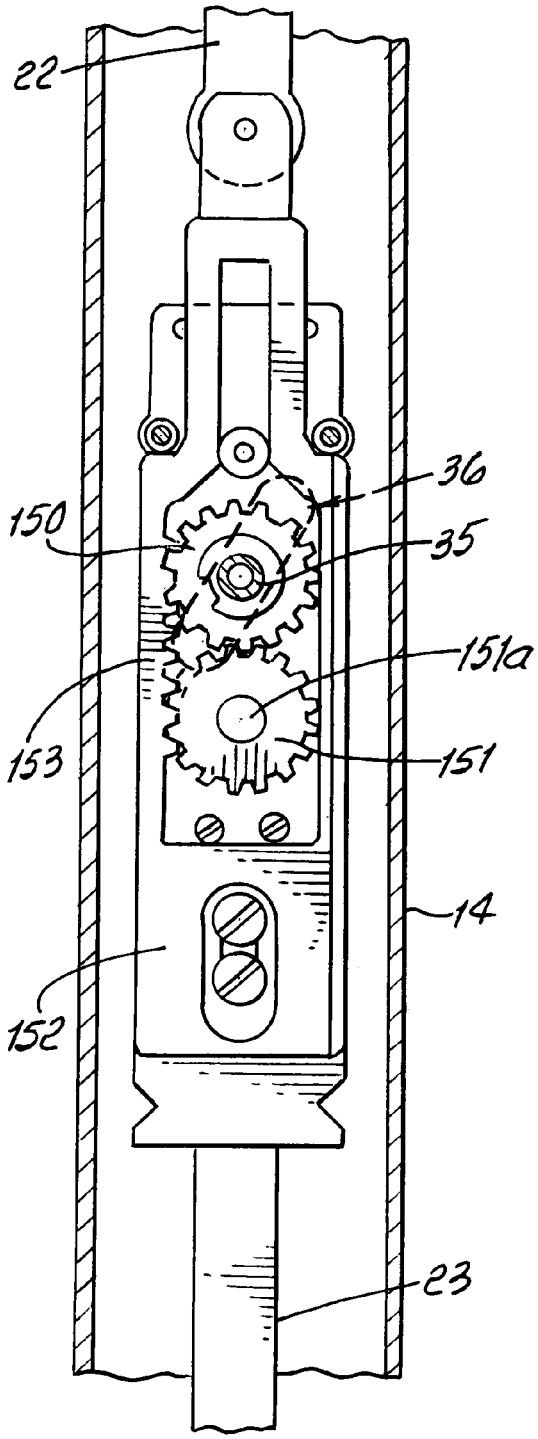
FIG. 11 is an elevation taken on lines 11-11 of FIG. 5, and showing mechanism in blocked position, corresponding to FIG. 3.
Figure 12:
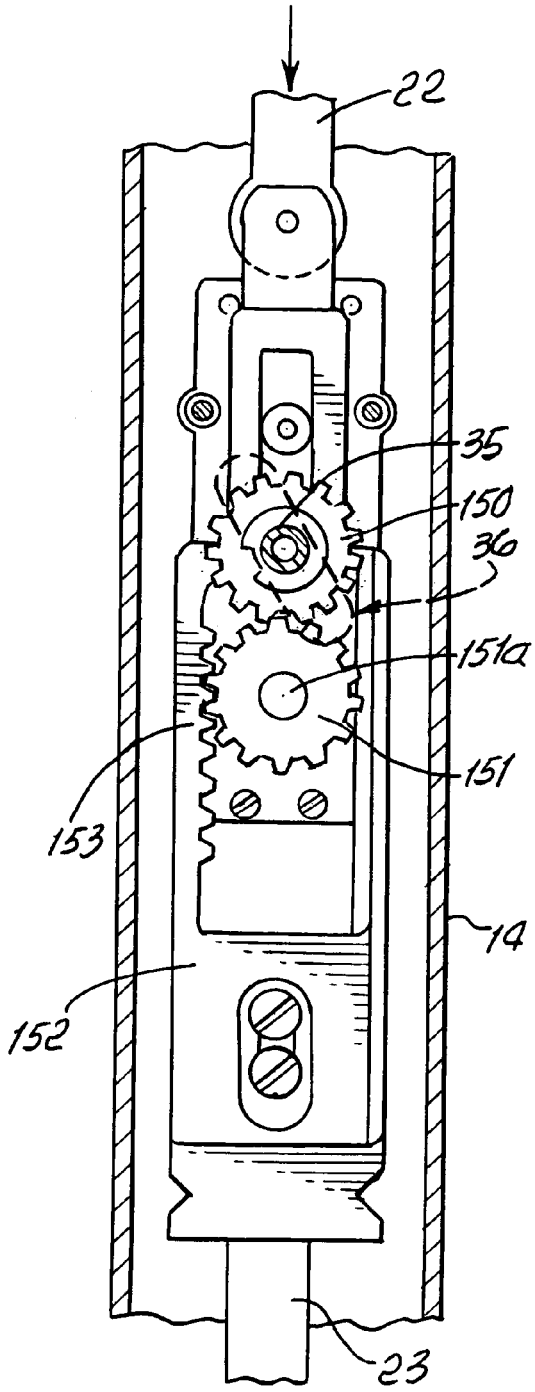
FIG. 12 is a view like FIG. 11, but showing the mechanism in unblocked position, corresponding to FIG. 4.

Referring now to FIGS. 7, 11 and 12, it will be observed that as lever 20 is manually rotated, the projection 50 is rotated upwardly, i.e. the throw movement of the projections. This movement is depended upon to cause the door locking rods 22 and 23 to be displaced from FIG. 2 unlocking positions into FIG. 1 locking positions. In accordance with a further object of the invention, displacement compensation means is provided for compensating the rotary movement of the lever 20 and projection 50 to the bodily movement of the locking rods.

As shown in FIGS. 11 and 12, such compensation means includes a first spur gear 150 operatively coupled to the knob 18, via shaft 35, and a second spur gear 151 on shaft 151*a*. Gear 151 meshes with gear 150, and is operatively coupled as via rack 153 to, or carried by, an element, such as slider 152 that is displaced upwardly in response to the throw movement of the lever and its projection 50. In this regard, the first gear 150 has a number of teeth $N_1$, and the second gear has a number of teeth $N_2$, there $N_1/N_2$ exceeds 1, creating the compensation, as gear 151 drives gear 150. Thus, projection 50 drives rack 153 upwardly from FIG. 12 to FIG. 11 position, which rotates gear 151 to drive gear 150, which rotates shaft 35, effecting locking rod endwise movement, as described in connection with FIGS. 13 and 14.

As shown in FIG. 5, the generally closely compact, parallel relationship of components contributes to a high degree of utility in a doorway installation environment.

I claim:

1. A method of unlocking one or both of first and second doors, wherein the first and second doors are side by side doors, the method comprising:

a) providing first and second rotary input devices, b) providing first means for unlocking said first door responsive to manual rotation of said first rotary input device, c) providing second means for unlocking said first and second doors responsive to manual rotation of said second rotary input device, d) said second means operatively coupled to said first means for activating said first means after predetermined rotation of said second rotary input device, e) providing movable lock rod means for locking and unlocking said first door in response to rotation of said first rotary input device, said lock rod means operatively coupled to both of said first and second means, f) providing a displacement compensation means for compensating the rotary movement of said second rotary input device to the movement of said lock rod means, wherein said displacement compensation means includes a first gear operatively coupled to said first rotary input device, a second gear meshing with said first gear and operatively coupled to an element displaced in response to the throw movement of said second rotary input device, said first gear having a number of teeth $N_1$ and said second gear having a number of teeth $N_2$, where $N_1/N_2>1$; and g) wherein one of said first and second rotary input devices is a rotatable knob, and the other of said first and second rotary input devices is a rotatable handle lever.

2. The method of claim 1 wherein said first and second rotary input devices have axes of rotation, at generally the same vertical level.

3. The method of claim 1 wherein said first and second rotary input devices are at opposite sides, respectively, of the doors.

4. The method of claim 1 wherein said first means includes a latch mechanism located for release to control unlocking of said first door, in response to rotation of either of said first and second rotary input devices.

5. The method of claim 1 including primary and secondary upright frame members, the primary member carrying said first rotary input device and the secondary member carrying said second rotary input device, wherein said first door includes said primary frame member, and wherein said second door includes said secondary frame member.

6. The method of claim 5 wherein said rotatable handle lever is a manually turnable lever.

7. The method of claim 6 wherein said first means includes a latch mechanism located for release to control unlocking of said first door in response to rotation of either of said first or second rotary input devices.

8. The method of claim 7 wherein said rotatable handle lever includes a projection extending between said primary and secondary frame members and into registration with said primary upright frame member to operate said latching mechanism which is carried by said secondary frame member.

9. The method of claim 1 including a bolt openable by the door to engage and disengage a frame member as said rotatable handle lever is rotated.

10. The method of claim 1 wherein said element comprises a rack meshing with said second gear.

11. A method of unlocking one or both of first and second doors, wherein the first and second doors are side by side doors, the method comprising:

a) providing first and second rotary input devices, b) providing first means for unlocking said first door responsive to manual rotation of said first rotary input device, c) providing second means for unlocking said first and second doors responsive to manual rotation said second rotary input device, d) said second means operatively coupled to said first means for activating said first means after predetermined rotation of said second rotary input device, e) said first means including a latching mechanism located for release to control unlocking of said first door, in response to rotation of either of said first and second rotary input devices, wherein said latching mechanism includes:

i) a transverse shaft, ii) a linkage operatively connecting said shaft to said lock rod means to displace said lock rod means endwise in response to shaft rotation, iii) spring means for urging said lock rod means in an unlocking direction or directions, iv) a blocking cam rotatable by said shaft, v) a latch releasably blocking rotation of said blocking cam, vi) a slider bodily movable to displace said latch to cam rotation unblocking position, vii) said second rotary input device manually rotated to move said slider, f) providing endwise movable lock rod means for locking and unlocking said first door in response to rotation of said first rotary input device, said lock rod means operatively coupled to both of said first and second means.

12. A method of unlocking one or both of first and second doors, wherein the first and second doors are side by side doors, the method comprising:

a) providing first and second rotary input devices, b) providing first means for unlocking said first door responsive to manual rotation of said first rotary input device, c) providing second means for unlocking said first and second doors responsive to manual rotation of said second rotary input device, d) said second means operatively coupled to said first means for activating said first means after predetermined rotation of said second rotary input device, e) providing movable lock rod means for locking and unlocking said first door in response to rotation of said first rotary input device, said lock rod means operatively coupled to both of said first and second means, and f) providing a displacement compensation means for compensating the rotary movement of said second rotary input device to the movement of said lock rod means, wherein said displacement compensation means includes a first gear operatively coupled to said first rotary input device, a second gear meshing with said first gear and operatively coupled to an element displaced in response to the throw movement of said second rotary input device, said first gear having a number of teeth $N_1$ and said second gear having a number of teeth $N_2$, where $N_1/N_2>1$.

* * * * *